US007575046B2

(12) United States Patent
Kandlikar

(10) Patent No.: US 7,575,046 B2
(45) Date of Patent: Aug. 18, 2009

(54) METHODS FOR STABILIZING FLOW IN CHANNELS AND SYSTEMS THEREOF

(75) Inventor: Satish G. Kandlikar, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 10/939,896

(22) Filed: Sep. 13, 2004

(65) Prior Publication Data

US 2005/0061481 A1 Mar. 24, 2005

Related U.S. Application Data

(60) Provisional application No. 60/504,267, filed on Sep. 18, 2003.

(51) Int. Cl.
*F28F 13/18* (2006.01)

(52) U.S. Cl. ..... 165/133; 165/146; 165/911

(58) Field of Classification Search ..... 165/133, 165/84, 911, 146
See application file for complete search history.

(56) References Cited

U.S. PATENT DOCUMENTS 3,578,072 A * 5/1971 Kolm ..... 165/84
4,050,507 A * 9/1977 Chu et al. ..... 165/133
4,503,840 A 3/1985 Chertok
4,602,681 A * 7/1986 Daikoku et al. ..... 165/133
4,606,405 A * 8/1986 Nakayama et al. ..... 165/133
4,700,771 A * 10/1987 Bennett et al. ..... 165/133
5,054,548 A * 10/1991 Zohler ..... 165/133
5,152,337 A * 10/1992 Kawakatsu et al. ..... 165/111
5,372,188 A * 12/1994 Dudley et al. ..... 165/110
5,398,519 A * 3/1995 Weber et al. ..... 165/911
5,942,164 A * 8/1999 Tran ..... 261/128
6,357,522 B2 * 3/2002 Dienhart et al. ..... 165/177
6,371,199 B1 * 4/2002 Gebhart ..... 165/133
6,457,516 B2 * 10/2002 Brand et al. ..... 165/133
2002/0079089 A1 * 6/2002 Kang et al. ..... 165/84

OTHER PUBLICATIONS

Kandlikar, S. G., "Fundamental Issues Related To Flow Boiling In Minichannels and Microchannels," *Experimental Thermal and Fluid Science* 26:389-407 (2002).

Kandlikar, S. G., "Heat Transfer Mechanisms During Flow Boiling In Microchannels," *Proceedings of the First International Conference on Microchannels and Minichannels*, Apr. 24-25, 2003, Rochester, New York, USA ICMM2003-1005, ASME Publicaiton (2003).

"The Handbook of Phase Change: Boiling and Condensation," Taylor and Francis, pp. 370-372 (1999).

Peles et al., "Evaporating Two-Phase Flow Mechanism In Micro-Channels," Part of the Symposium on Design, Test, and Microfabrication of MEMS and MOEMS, Paris, France, SPIE, vol. 3680, pp. 226-236 (1999).

(Continued)

*Primary Examiner*—Leonard R Leo
(74) *Attorney, Agent, or Firm*—Nixon Peabody LLP

(57) ABSTRACT

A method and system for stabilizing flow includes introducing a flow into a channel with a minimum cross-sectional dimension of less than three millimeters and triggering a release of one or more bubbles in the flow at one or more locations in the channel. The one or more locations are spaced in from an inlet and an outlet to the channel.

5 Claims, 6 Drawing Sheets

OTHER PUBLICATIONS

Kandlikar et al., "Experimental Evaluation of Pressure Drop Elements and Fabricated Nucleation Sites For Stabilizing Flow Boiling In Minichannels And Microchannels," (Paper No. ICMM2005-75197), Conference Proceedings of ICMM2005 3rd International Conference on Microchannels and Minichannels, Toronto, Ontario, Canada, pp. 1-10 (2005).

Mukherjee et al., "Numerical Study Of The Effect Of Inlet Constriction On Bubble Growth During Flow Boiling In Microchannels," (Paper No. ICMM2005-75143), Conference Proceedings of ICMM2005 3rd International Conference on Microchannels and Minichannels, Toronto, Ontario, Canada, pp. 1-8, (2005).

* cited by examiner

METHODS FOR STABILIZING FLOW IN CHANNELS AND SYSTEMS THEREOF

The present invention claims the benefit of U.S. Provisional Patent Application Ser. No. 60/504,267, filed Sep. 18, 2003, which is hereby incorporated by reference in its entirety.

FIELD OF THE INVENTION

The present invention generally relates to microchannels and minichannels and, more particularly, to methods and systems for stabilizing flow and/or improving heat transfer performance in microchannels and minichannels and systems thereof.

BACKGROUND

In a cooling system with a network of multiple parallel microchannels and minichannels, each having a hydraulic diameter less than three mm, a liquid used for cooling is introduced. As the liquid flows through the network, initially heat transfer is by convection from the walls of the microchannels and minichannels.

As the liquid flows further downstream through the network, additional heating of the liquid occurs. Eventually, the wall temperature of the microchannels and minichannels rises above the local saturation temperature of the liquid. However, boiling of the liquid does not occur unless there are proper nucleation cavities present. If one or more nucleation cavities are present, nucleation occurs over the nucleation cavity or cavities and the liquid boils. The range of possible nucleation cavities in the microchannels and minichannels can be expanded by the application of a sufficiently high degree of superheat to the microchannels and minichannels.

Prior to this nucleation occurring and during the superheating, the liquid in the microchannels and minichannels, at least in the vicinity of the nucleation sites, becomes superheated. At this point, a bubble present or formed in this liquid experiences a very rapid bubble growth. The rapid bubble growth leads to severe pressure fluctuation in the microchannel or minichannel, which can result in a reverse flow of the liquid. Experimental evidence and a description of the mechanism leading to this instability is described in Kandlikar, S.G. "Heat Transfer Mechanisms During Flow Boiling In Microchannels." Proceedings of the First International Conference on Microchannels and Minichannels Apr. 24-25, 2003, Rochester, N.Y., USA ICMM2003-1005, S. G. Kandlikar, Editor ASME Publication, 2003, which is herein incorporated by reference in its entirety. The rapid bubble growth may also adversely affect the heat transfer performance, including heat transfer degradation and/or reduction in critical heat flux, of the cooling system.

SUMMARY OF THE INVENTION

A method for stabilizing flow during flow boiling in accordance with embodiments of the present invention includes introducing a flow into a channel with a minimum cross-sectional dimension of less than three millimeters and triggering a release of one or more bubbles in the flow at one or more locations in the channel to stabilize the flow. The one or more locations are spaced in from an inlet and an outlet to the channel.

A system for stabilizing flow during flow boiling in accordance with embodiments of the present invention includes the channel and the triggering system. The channel has a minimum cross-sectional dimension of less than three millimeters. The triggering system triggers a release of one or more bubbles in the flow at one or more locations in the channel to stabilize the flow. The one or more locations are spaced in from an inlet and an outlet to the channel.

The present invention provides a method and system for the efficient removal of the heat potential of flow boiling in a channel or channels, such as microchannels and minichannels. The present invention overcomes the severe oscillatory nature of the flow during flow boiling by initiating the nucleation and flow boiling at specific locations in the channel or channels. The locations are chosen such that the local superheat in the wall and/or surrounding liquid is relatively low and does not lead to the rapid bubble growth that leads to flow and pressure oscillations. Flow and pressure oscillations can lead to flow reversal and premature drying out and to a reduction in cooling performance. To assist in initiating nucleation the present invention heats a region with or immediately preceding a location with nucleation cavities. To provide additional flow stability the present invention may also incorporate local pressure reduction devices.

DETAILED DESCRIPTION

Systems 10(1)-10(10) for stabilizing flow F in one or more channels 12(1)-12(10) in accordance with embodiments of the present invention are illustrated in FIGS. 1-8. The systems 10(1)-10(10) each have a channel 12(1)-12(10) which each includes one or more low pressure devices 14(1)-14(3), low pressure zones 16(1)-16(4), heating device 18(1)-18(2), and/or nucleation cavities 20(1)-20(7), although the systems 10(1)-10(10) each can include other types and numbers of elements arranged in other manners. The present invention provides a number of advantages including providing systems and methods for efficiently removing the heat potential of flow boiling in microchannels and minichannels. The present invention overcomes the severe oscillatory nature of the flow F during flow boiling by initiating the nucleation and flow boiling at specific locations in the channel or channels. The locations are chosen such that the local superheat in the wall of the channel or channels and/or surrounding flow is relatively low and does not lead to the rapid growth of bubbles that lead to flow and pressure oscillations.

Referring more specifically to FIGS. 1-8, each of the channels 12(1)-12(10) is either a minichannel or a microchannel. A minichannel has a minimum cross-sectional dimension between about 200 microns to three millimeters and a microchannel has a minimum dimension of about 200 microns or less. The cross-sectional dimension is measured across the channel in a direction which is substantially perpendicular to the direction of the flow. Although hydraulic diameter is described in, Kandlikar, S. G. "Heat Transfer Mechanisms During Flow Boiling In Microchannels." Proceedings of the First International Conference on Microchannels and Minichannels Apr. 24-25, 2003, Rochester, N.Y., USA ICMM2003-1005, S. G. Kandlikar, Editor ASME Publication, 2003, the above classification is used for microchannels and minichannels herein. In these embodiments, the channels 12(1)-12(10) each have a circular, cross-sectional shape, although each of the channels 12(1)-12(10) could have other cross-sectional shapes. The arrow F represents the flow flowing in the channels 12(1)-12(10) and also indicates the direction of that flow. A variety of different types of flow F, such as fluids, can pass through the channels 12(1)-12(10) and the flow F can go in other directions.

Figure 1:
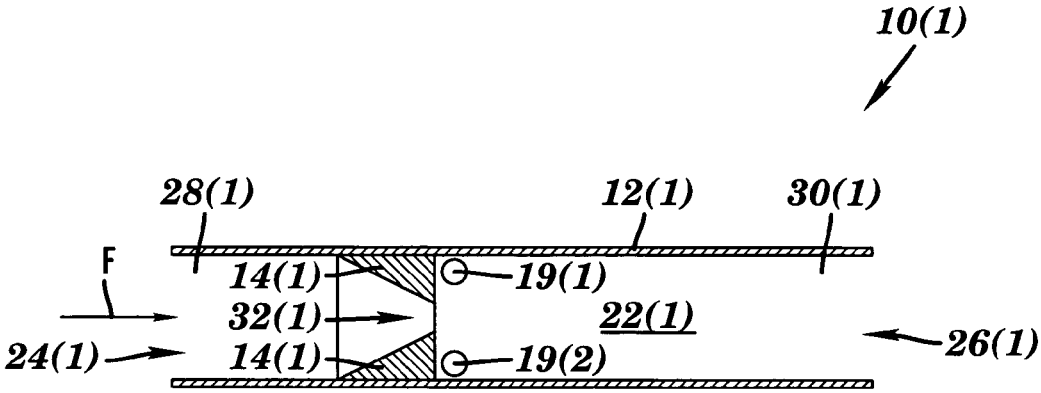
FIG. 1 is a cross-sectional view of a system with a low pressure zone for stabilizing flow which is flowing from left to right in a microchannel or minichannel in accordance with embodiments of the present invention.

Referring to FIG. 1, the system 10(1) for stabilizing flow F includes the channel 12(1) with the low pressure device 14(1), although system 10(1) can include other types and numbers of elements arranged in other manners. The flow F is a liquid in this and the other systems 10(1)-10(10) described herein, although other types of mediums can be used for the flow F. The channel 12(1) has a wall which defines a passage 22(1) that is substantially straight and includes an inlet 24(1) and an outlet 26(1), although the channel 12(1) could have other configurations, such as a curved shape, and other numbers of walls and openings.

The low pressure device 14(1) is positioned in the channel 12(1) and is spaced in from the inlet 24(1) and the outlet 26(1), although other numbers and types of pressure drop elements in other locations can be used. A pressure drop element, such as pressure device 14(1) refers to any element or configuration that creates a pressure drop, flashing, increased resistance to backflow, and/or creation of a low pressure zone. The flashing leads to the presence of vapor phase in the flow which prevents any further superheating of the wall and/or the flow F. Excess superheat is the cause for rapid bubble growth that leads to instability in the flow F.

The low pressure device 14(1) extends fully or partially around the inner periphery of the channel 12(1) and forms a high pressure region 28(1) upstream of the low pressure device 14(1) and forms a low pressure region 30(1) downstream of the low pressure device 14(1). A passage 32(1) extends through the low pressure device 14(1) to connect the high pressure region 28(1) to the low pressure region 30(1) with low pressure zones 19(1) and 19(2). The passage 32(1) has a cone-shaped, inner periphery with the larger opening to this cone-shaped, inner periphery facing the high pressure region 28(1), although the passage 32(1) could have other shapes and configurations.

Figure 2A:
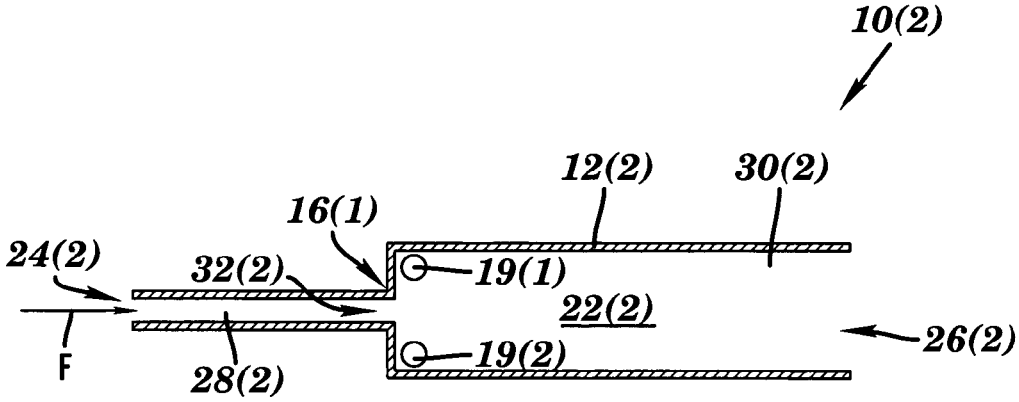
FIGS. 2A and 2B are cross-sectional views of systems with a low pressure zone for stabilizing flow which is flowing from left to right in a microchannel or minichannel in accordance with other embodiments of the present invention.

Referring to FIG. 2A, the system 10(2) for stabilizing flow F includes the channel 12(2) with the low pressure zone 16(1), although system 10(2) can include other types and numbers of elements arranged in other manners. Elements in FIG. 2A which correspond to those described with reference to FIG. 1 will have like reference numerals. The channel 12(2) has a wall which defines a passage 22(2) that has a high pressure region 28(2) which is narrower than and upstream from a low pressure region 30(2). The passage 22(2) also includes an inlet 24(2) and an outlet 26(2), although the channel 12(2) and passage 22(2) could have other configurations with other numbers, shapes, and types of regions and other numbers of walls and openings. The low pressure zone 16(1) is adjacent the transition from the high pressure region 28(2) to the low pressure region 30(2) with low pressure zones 19(1) and 19(2). A passage 32(2) connects the high pressure region 28(2) to the low pressure region 30(2)

Figure 2B:
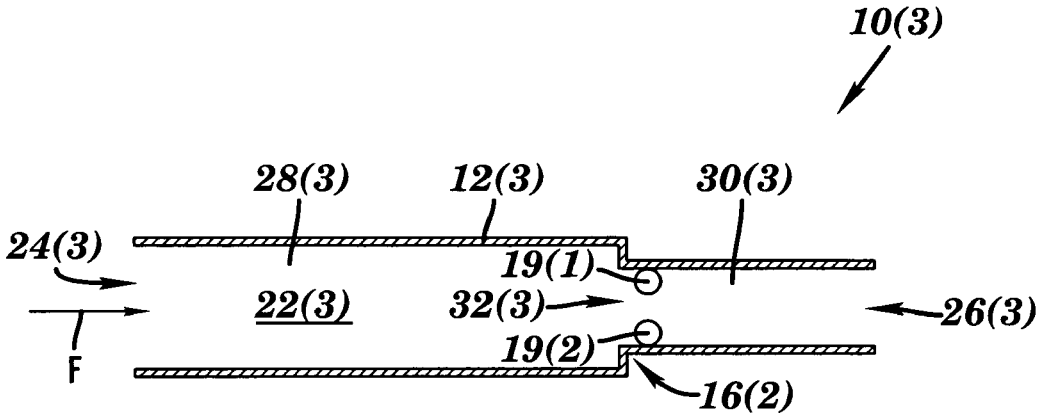

Referring to FIG. 2B, the system 10(3) for stabilizing flow F includes the channel 12(3) with the low pressure zone 16(2), although system 10(3) can include other types and numbers of elements arranged in other manners. Elements in FIG. 2B which correspond to those described with reference to FIGS. 1 and 2A will have like reference numerals. The channel 12(3) has a wall which defines a passage 22(3) that has a high pressure region 28(3) which is wider than and upstream from a low pressure region 30(3).

The passage 22(3) also includes an inlet 24(3) and an outlet 26(3), although the channel 12(3) and passage 22(3) could have other configurations with other numbers, shapes, and types of regions and other numbers of walls and openings. The low pressure zone 16(2) is adjacent the transition from the high pressure region 28(3) to the low pressure region 30(3). A passage 32(3) connects the high pressure region 28(2) to the low pressure region 30(2) with low pressure zones 19(1) and 19(2).

Figure 3:
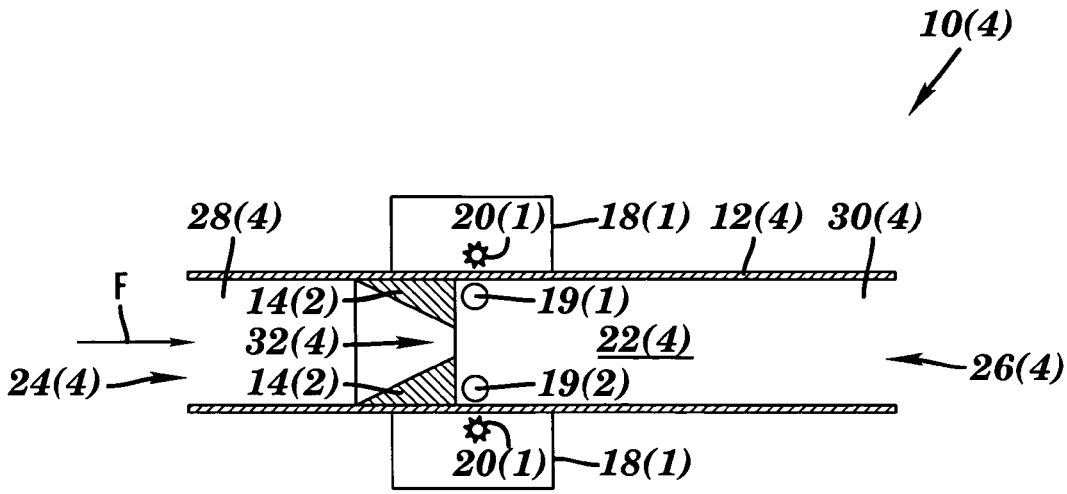
FIG. 3 is a cross-sectional view of the system shown in FIG. 1 with a heater and with a flow direction from left to right in accordance with other embodiments of the present invention.

Referring to FIG. 3, the system 10(4) for stabilizing flow F includes the channel 12(4) with the low pressure device 14(2), the heating device 18(1) and the nucleation cavities 20(1), although system 10(4) can include other types and numbers of elements arranged in other manners. Elements in FIG. 3 which correspond to those described with reference to FIGS. 1-2B will have like reference numerals. The channel 12(4) has a wall which defines a passage 22(4) that is substantially straight and includes an inlet 24(4) and an outlet 26(4), although the channel 12(4) could have other configurations, such as a curved shape, and other numbers of walls and openings.

The low pressure device 14(2) is positioned in the channel 12(4) and is spaced in from the inlet 24(4) and the outlet 26(4), although other numbers and types of pressure drop elements in other locations can be used as described earlier. The low pressure device 14(2) extends fully or partially around the inner periphery of the channel 12(4) and forms a high pressure region 28(4) upstream of the low pressure device 14(2) and forms a low pressure region 30(4) downstream of the low pressure device 14(2). A passage 32(4) extends though the low pressure device 14(2) to connect the high pressure region 28(4) to the low pressure region 30(4) with low pressure zones 19(1) and 19 (2). The passage 32(4) has a cone-shaped, inner periphery with the larger opening to this cone-shaped, inner periphery facing the high pressure region 28(4), although the passage 32(4) could have other shapes and configurations.

The heating device 18(1) is positioned around the wall of the channel 22(4) adjacent the low pressure device 14(2) and is used to superheat the adjacent portion of the channel, although other numbers and types of heating systems in other locations could be used. The heating device 18(1) is also positioned over nucleation cavities 20(1) which are located in the wall of the channel 22(4), although other numbers and locations for the nucleation cavities and other types of reentrant or nucleation sites can be used. The actual size and shape of the nucleation cavities 20(1) is based on the geometry of the channel 22(4) and the range of flow conditions that the channel 22(4) is subject to.

Figure 4A:
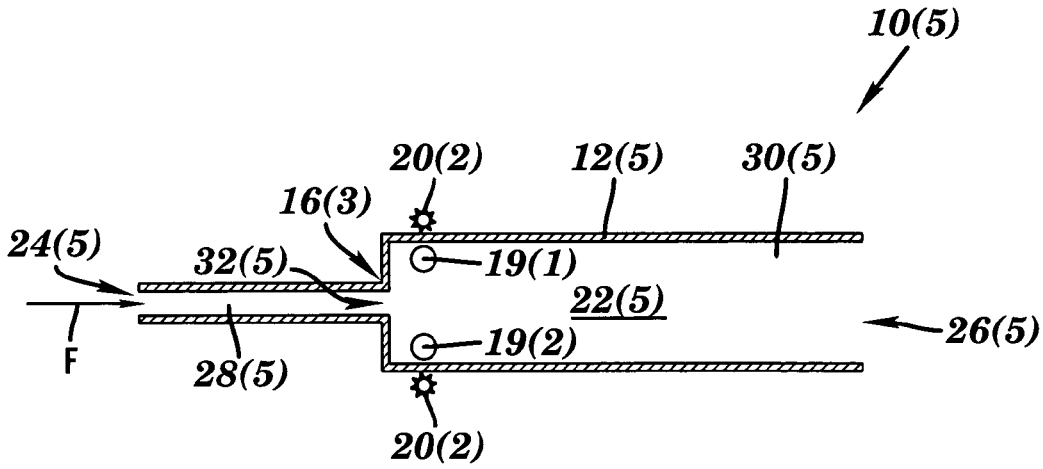
FIGS. 4A and 4B are cross-sectional views of the systems with a low pressure zone as shown in FIGS. 2A and 2B respectively with nucleation cavities and with a flow direction from left to right in accordance with other embodiments of the present invention.

Referring to FIG. 4A, the system 10(5) for stabilizing flow F includes the channel 12(5) with the low pressure zone 16(3), although system 10(5) can include other types and numbers of elements arranged in other manners. Elements in FIG. 4A which correspond to those described with reference to FIGS. 1-3 will have like reference numerals. The channel 12(5) has a wall which defines a passage 22(5) that has a high pressure region 28(5) which is narrower than and upstream from a low pressure region 30(5). The passage 22(5) also includes an inlet 24(5) and an outlet 26(5), although the channel 12(5) and passage 22(5) could have other configurations with other numbers, shapes, and types of regions and other numbers of walls and openings. The low pressure zone 16(3) is adjacent the transition from the high pressure region 28(5) to the low pressure region 30(5) with low pressure zones 19(1) and 19(2). A passage 32(5) connects the high pressure region 28(5) to the low pressure region 30(5).

Nucleation cavities 20(2) are located in the wall of the channel 22(5) adjacent the low pressure zone 16(3), although other numbers and locations for the nucleation cavities and other types of reentrant or nucleation sites can be used. The actual size and shape of the nucleation cavities 20(2) is based on the geometry of the channel 22(5) and the range of flow conditions that the channel 22(5) is subject to.

Figure 4B:
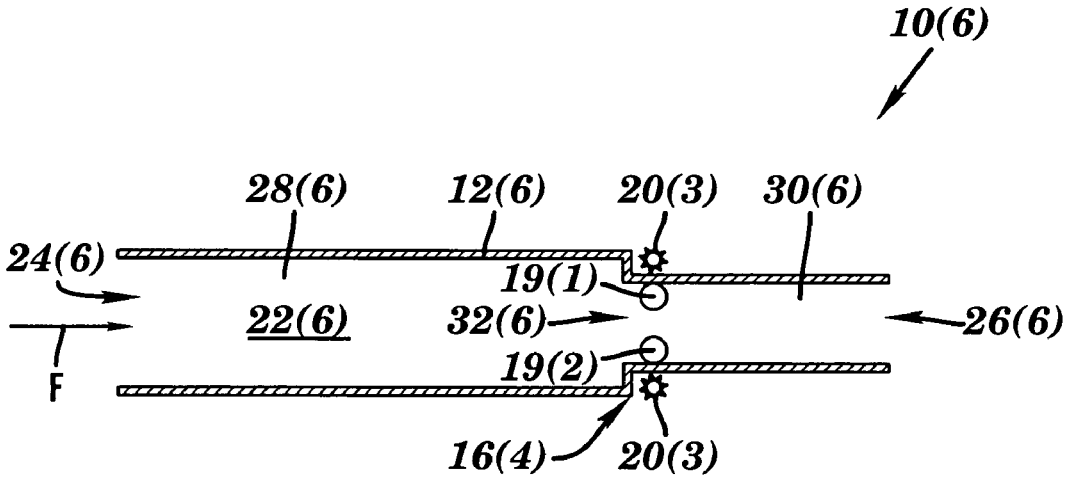

Referring to FIG. 4B, the system 10(6) for stabilizing flow F includes the channel 12(6) with the low pressure zone 16(4), although system 10(6) can include other types and numbers of elements arranged in other manners. Elements in FIG. 4B correspond to those described with reference to FIGS. 1-4A will have like reference numerals. The channel 12(6) has a wall which defines a passage 22(6) that has a high pressure region 28(6) which is wider than and upstream from a low pressure region 30(6) with low pressure zones 19(1) and 19(2). The passage 22(6) also includes an inlet 24(6) and an outlet 26(6), although the channel 12(6) and passage 22(6) could have other configurations with other numbers, shapes, and types of regions and other numbers of walls and openings. The low pressure zone 16(4) is adjacent the transition from the high pressure region 28(6) to the low pressure region 30(6). A passage 32(6) connects the high pressure region 28(6) to the low pressure region 30(6).

Nucleation cavities 20(3) are located in the wall of the channel 22(6) adjacent the low pressure zone 16(4), although other numbers and locations for the nucleation cavities and other types of reentrant or nucleation sites can be used. The actual size and shape of the nucleation cavities 20(3) is based on the geometry of the channel 22(6) and the range of flow conditions that the channel 22(6) is subject to.

Figure 5:
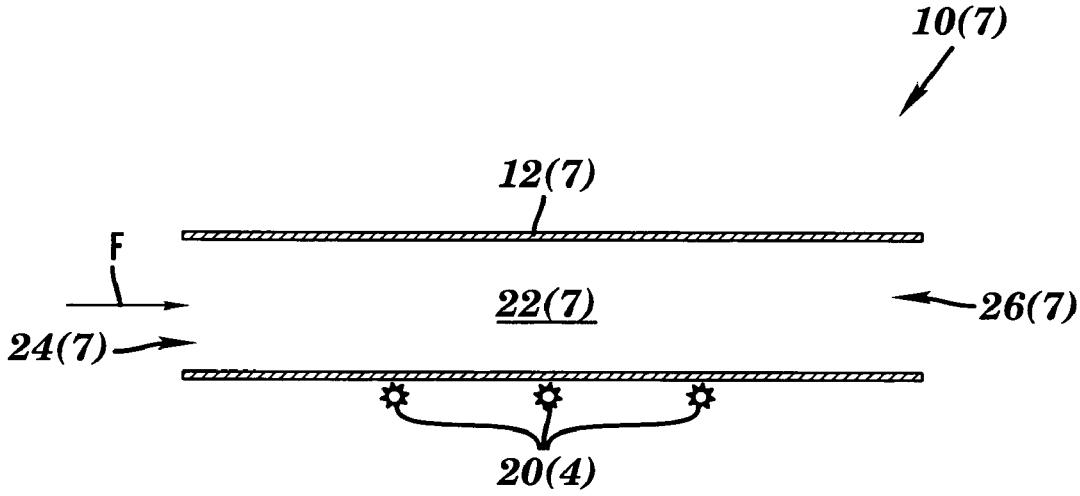
FIG. 5 is a cross-sectional view of a system with nucleation cavities for stabilizing flow in a microchannel or minichannel along one surface in accordance with other embodiments of the present invention.

Referring to FIG. 5, the system 10(7) for stabilizing flow F includes the channel 12(7) with nucleation cavities 20(4), although system 10(7) can include other types and numbers of elements arranged in other manners. Elements in FIG. 5 which correspond to those described with reference to FIGS. 1-4B will have like reference numerals. The channel 12(7) has a wall which defines a passage 22(7) that is substantially straight and includes an inlet 24(7) and an outlet 26(7), although the channel 12(7) could have other configurations, such as a curved shape, and other numbers of walls and openings.

Nucleation cavities 20(4) are spaced apart substantially the same distance along a section of the wall of the channel 22(7), although other numbers and locations for the nucleation cavities and other types of reentrant or nucleation sites can be used. The actual size and shape of the nucleation cavities 20(4) is based on the geometry of the channel 22(7) and the range of flow conditions that the channel 22(7) is subject to.

Figure 6:
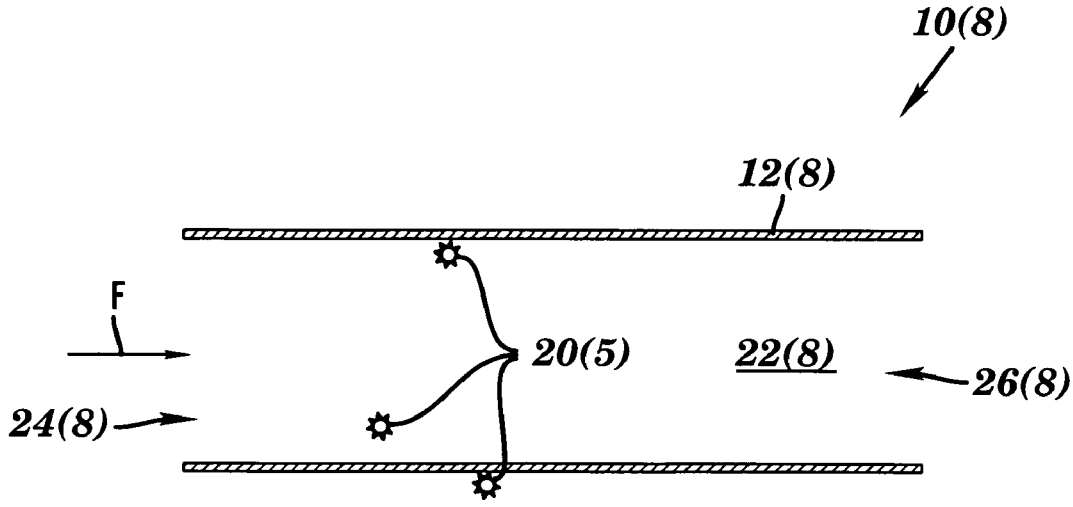
FIG. 6 is a cross-sectional view of a system with nucleation cavities for stabilizing flow in a microchannel or minichannel in a systematic or random pattern in accordance with other embodiments of the present invention.

Referring to FIG. 6, the system 10(8) for stabilizing flow F includes the channel 12(8) with nucleation cavities 20(5), although system 10(8) can include other types and numbers of elements arranged in other manners. Elements in FIG. 6 which correspond to those described with reference to FIGS. 1-5 will have like reference numerals. The channel 12(8) has a wall which defines a passage 22(8) that is substantially straight and includes an inlet 24(8) and an outlet 26(8), although the channel 12(8) could have other configurations, such as a curved shape, and other numbers of walls and openings.

Nucleation cavities 20(5) are randomly located along a section of the wall of the channel 22(8), although other numbers and locations for the nucleation cavities and other types of reentrant or nucleation sites can be used. The actual size and shape of the nucleation cavities 20(5) is based on the geometry of the channel 22(8) and the range of flow conditions that the channel 22(8) is subject to.

Referring to FIG. 1, the system 10(9) for stabilizing flow F includes the channel 12(9) with the low pressure device 14(3) and nucleation cavities 20(6), although system 10(9) can include other types and numbers of elements arranged in other manners. Elements in FIG. 7 which correspond to those described with reference to FIGS. 1-6 will have like reference numerals. The channel 12(9) has a wall which defines a passage 22(9) that is substantially straight and includes an inlet 24(9) and an outlet 26(9), although the channel 12(9) could have other configurations, such as a curved shape, and other numbers of walls and openings.

The low pressure device 14(3) is positioned in the channel 12(9) and is spaced in from the inlet 24(9) and the outlet 26(9), although other numbers and types of pressure drop elements in other locations can be used as described earlier. The low pressure device 14(3) extends fully or partially around the inner periphery of the channel 12(9) and forms a high pressure region 28(7) upstream of the low pressure device 14(3) and forms a low pressure region 30(7) downstream of the low pressure device 14(3). A passage 32(7) extends through the low pressure device 14(3) to connect the high pressure region 28(7) to the low pressure region 30(7). The passage 32(7) has a cone-shaped, inner periphery with the larger opening to this cone-shaped, inner periphery facing the high pressure region 28(7), although the passage 32(7) could have other shapes and configurations.

Nucleation cavities 20(6) are spaced apart substantially the same distance along a section of the wall of the channel 22(9), although other numbers and locations for the nucleation cavities and other types of reentrant or nucleation sites can be used. The actual size and shape of the nucleation cavities 20(6) is based on the geometry of the channel 22(9) and the range of flow conditions that the channel 22(9) is subject to.

Figure 7:
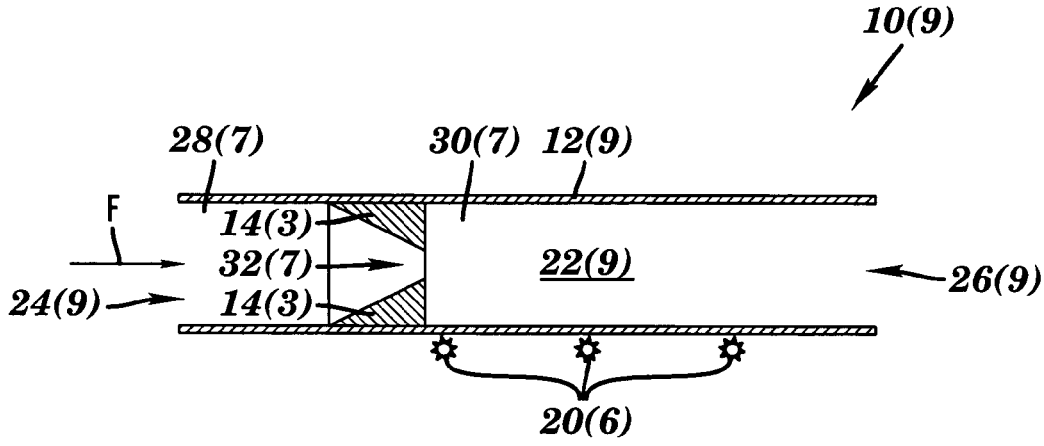
FIG. 7 is a cross-sectional view of a system with a low pressure zone and nucleation cavities for stabilizing flow in a microchannel or minichannel in accordance with embodiments of the present invention.
Figure 8:
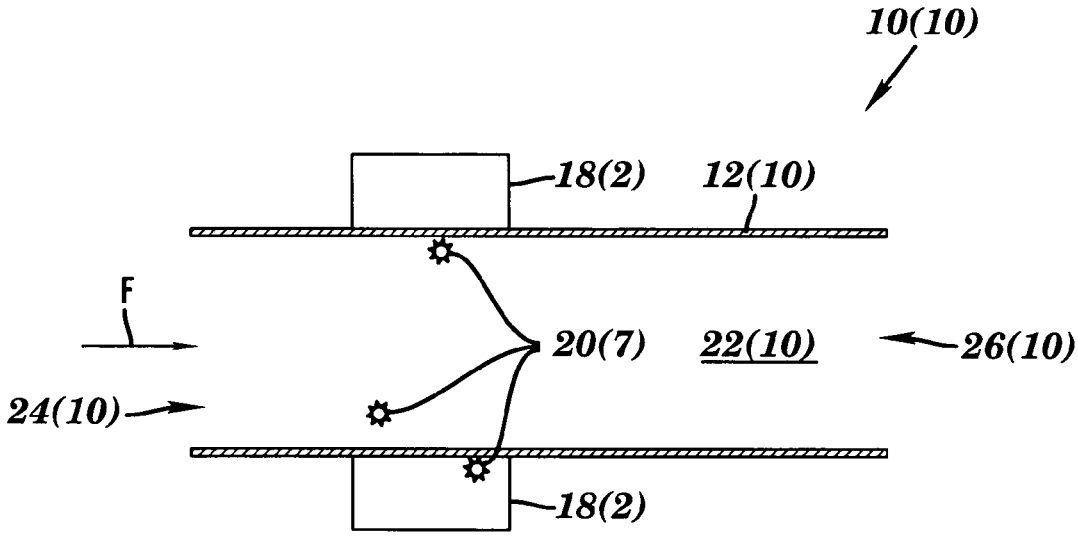
FIG. 8 is a cross-sectional view of a system for stabilizing flow in a microchannel or minichannel in a systematic or random pattern with a heater in accordance with other embodiments of the present invention.

Referring to FIG. 8, the system 10(10) for stabilizing flow F includes the channel 12(10) the heating device 18(2) and the nucleation cavities 20(7), although system 10(10) can include other types and numbers of elements arranged in other manners. Elements in FIG. 8 which correspond to those described with reference to FIGS. 1-7 will have like reference numerals. The channel 12(10) has a wall which defines a passage 22(10) that is substantially straight and includes an inlet 24(10) and an outlet 26(10), although the channel 12(10) could have other configurations, such as a curved shape, and other numbers of walls and openings.

The heating device 18(2) is positioned around the wall of the channel 12(10) adjacent the nucleation cavities 20(7), although other numbers and types of heating systems in other locations could be used.

Nucleation cavities 20(7) are randomly located along a section of the wall of the channel 22(10), although other numbers and locations for the nucleation cavities and other types of reentrant or nucleation sites can be used. The actual size and shape of the nucleation cavities 20(7) is based on the geometry of the channel 22(10) and the range of flow conditions that the channel 22(10) is subject to.

With the systems 10(1)-10(10) described above, the instability in the flow F is reduced and performance improvement is achieved by triggering an earlier nucleation in the flow F. The triggered early nucleation in the systems 10(1)-10(10) results in smaller vapor bubbles or slugs that are separated by relatively uniform liquid slugs and that do not grow too rapidly. The smaller vapor bubbles or slugs improve the heat transfer performance in the systems 10(1)-10(10) because the liquid film of the small vapor bubbles or slugs covering the wall or walls in the channels 12(1)-12(10) does not completely evaporate and is able to transfer heat before leaving the region. As a result, degradation in the cooling performance of systems 10(1)-10(10) is avoided.

The rapid growth of bubbles leads to reversed flow of vapor into an inlet manifold coupled to one or more of the channels 12(1)-12(10). This leads to flow instabilities and flow maldistribution in parallel channels.

The process of nucleation depends on the availability of nucleation cavities of the right size and shape which satisfy the nucleation criteria as described in an equation proposed by Hsu and Graham, rewritten in the following form by Kandlikar (Handbook of Phase Change, Taylor and Francis, 1999, which is herein incorporated by reference in its entirety) has the following form, and it provides the cavity radii range that can nucleate under a given set of local conditions. This equation, referred to as Equation 1 or eq. 1 herein, is as follows:

$$r^*_{\max}, r^*_{\min} = \frac{1}{2}\left[\frac{\Delta T^*_{sat}}{\Delta T_{sat} + \Delta T^*_{sub}} \pm \sqrt{\left(\frac{\Delta T^*_{sat}}{\Delta T^*_{sat} + \Delta T^*_{sub}}\right)^2 - \frac{1}{(\Delta T^*_{sat} + \Delta T^*_{sub})}}\right]$$

where $r^* = r/\delta_t$ $\Delta T^*_{sat} = \Delta T_{sat} h_{lv} \delta_t / (8\sigma T_{sat} v_{lv})$ $\Delta T^*_{sub} = \Delta T_{sub} h_{lv} \delta_t / (8\sigma T_{sat} v_{lv})$ r-cavity mouth radius, $\delta_t$-thickness of the thermal boundary layer, approximately=h/k, where h is the single phase heat transfer coefficient prior to nucleation and k is the thermal conductivity of liquid $\Delta T_{sat}$-wall superheat, degree C.

$h_{lv}$-latent heat, J/kg $\sigma$-surface tension, N/m $T_{sat}$-saturation temperature, K $v_{lv}$-change in specific volume during evaporation, $m^3$/kg $\Delta T_{sub}$-local liquid subcooling, degree C.

$r^*_{max}$ and $r^*_{min}$ are the non-dimensional minimum and maximum cavity mouth radii that will nucleate according to criteria described in eq. (1). A number of modifications to the above criteria are available, such as having the temperature at the tip of the bubble protruding in the flow F to be at least equal to or higher than the saturation temperature. The nucleation criterion is also modified for a channel or channels that are not uniform over the circumference, such as a channel or channels with rectangular cross-section, and for a channel or channels where the local wall and flow temperature fields vary with circumferential location.

The operation of the system 10(1) for stabilizing flow F will be described with reference to FIG. 1. The location where the wall and/or the flow F is expected to be slightly superheated (within a few degrees), such that flashing occurs, may be identified. The low pressure device 14(1) can be positioned in the channel 12(1) before that location and spaced in from the inlet 24(1) and outlet 26(1) to the channel 12(1).

Next, the flow F enters the inlet 24(1) to the channel 12(1) and flows from the high pressure region 28(1) to the low pressure region 30(1) through the passage 32(1) in the low pressure device 14(1). The flow F heading towards the low pressure device 14(1) is kept in single phase flow by insulating the inner surface of the channel 12(1) so that nucleation or two-phase flow does not occur prior to passing through the low pressure device 14(1). The heat gain in the high pressure region 28(1) of the channel 12(1) is also controlled to keep the flow F from boiling.

The low pressure zone upstream from and adjacent to the low pressure device 14(1) triggers flashing to occur which leads to the presence of vapor phase, i.e. bubbles, in the flow F. This prevents any firther superheating of the wall of the channel 12(1) and/or flow F. The flow F with the bubbles is able to effectively transfer heat to the flow F through the wall of the channel 12(1) resulting in improved heat transfer characteristics when compared with prior systems. The low pressure device 14(1) also increases the resistance to backflow in the channel 12(1) to provide further flow stability.

In the system 10(1), a release of bubbles can also optionally be obtained by vibrating the flow in at least a portion of the channel 12(1). A variety of different types of systems and device could be used to vibrate the flow F in the channel, such as a vibrating device disposed in a portion of the flow F in the channel 12(1) or the walls of the channel 12(1).

The operation of the system 10(2) for stabilizing flow F will be described with reference to FIG. 2A. The operation of the system 10(2) is the same as the system 10(1), except as described herein. The flow F enters the inlet 24(2) to the channel 12(2) and flows from the high pressure region 28(2) to the low pressure region 30(2) through the passage 32(2). The low pressure zone upstream from and adjacent to the transition from the high pressure region 28(2) to the low pressure region 30(2) triggers flashing to occur which leads to the presence of vapor phase, i.e. bubbles, in the flow F. This prevents any further superheating of the wall of the channel 12(2) and/or flow F. The flow F with the bubbles is able to effectively transfer heat to the flow F through the wall of the channel 12(2) resulting in improved heat transfer characteristics when compared with prior systems. This configuration of the channel 12(2) with the high pressure region 28(2) of the channel being narrower than the low pressure region 30(2) also increases the resistance to backflow in the channel 12(2) to provide further flow stability.

The operation of the system 10(3) for stabilizing flow F will be described with reference to FIG. 2B. The operation of the system 10(3) is the same as the system 10(2), except as described herein. The flow F enters the inlet 24(3) to the channel 12(3) and flows from the high pressure region 28(3) to the low pressure region 30(3) through the passage 32(3). The low pressure zone upstream from and adjacent to the transition from the high pressure region 28(3) to the low pressure region 30(3) triggers flashing to occur which leads to the presence of vapor phase, i.e. bubbles, in the flow F. This prevents any further superheating of the wall of the channel 12(3) and/or flow F. The flow F with the bubbles is able to effectively transfer heat to the flow F through the wall of the channel 12(3) resulting in improved heat transfer characteristics when compared with prior systems. This configuration of the channel 12(3) with the high pressure region 28(3) of the channel being narrower than the low pressure region 30(3) also increases the resistance to backflow in the channel 12(3) to provide further flow stability.

The operation of the system 10(4) for stabilizing flow F will be described with reference to FIG. 3. The operation of the system 10(4) is the same as the system 10(1), except as described herein. Again, the location where the wall and/or the flow F is expected to be slightly superheated (within a few degrees), such that flashing occurs, may be identified. The low pressure device 14(2) can be positioned in the channel 12(4) before that location and spaced in from the inlet 24(4) and outlet 26(4) to the channel 12(4).

Nucleation cavities 20(1) are formed in the wall of the channel 12(4) at a location where the superheat of the flow F is moderate to initiate nucleation over the nucleation cavities 20(1), but is not large enough to create modest or severe instability in the flow F due to late nucleation. The mouth opening to at least some of nucleation cavities 20(1) fall within those prescribed by eq. (1) described earlier herein. A larger range of diameters for nucleation cavities 20(1) may be placed individually or in clusters at the desired locations to allow for slight departures from eq. (1) due to variations in fluid properties and to allow for uncertainties and other assumptions made (including uniform heat transfer coefficient over the perimeter) in deriving eq. (1) and to allow for a range of operating conditions, including flow rates, heat fluxes, operating pressure, and inlet conditions. The nucleation cavities 20(1) can be fabricated using a variety of different techniques, such as laser drilling, etching, deep ion etching, laser ablation, sintering, scraping and fin bending, roughness, or indentation. The heating device 18(1) is positioned around the channel 12(4) adjacent the location of the nucleation cavities 20(1). The nucleation cavities 20(1) can also have different sizes and shapes to initiate nucleation under different conditions and at different locations.

Once the system 10(4) is formed, the flow F enters the inlet 24(4) to the channel 12(4) and flows from the high pressure region 28(4) to the low pressure region 30(4) through the passage 32(4) in the low pressure device 14(2). The heating device 18(1) heats the wall of the channel adjacent the location of the nucleation cavities 20(1). Heating the nucleation cavities 20(1) helps to initiate nucleation in the flow F. The heating device 18(1) could be supplied with essentially constant power or with power pulses to release bubbles over the nucleation cavities 20(1) periodically to initiate boiling and reduce the level of superheat attained by the flow F. The period of bubble release is determined so that the pressure oscillations in the flow F are reduced to prevent flow reversal or other detrimental effects of large superheat buildup prior to nucleation. Although a heating device 18(1) is shown, other mechanisms for bubble release can be used, such as mechanisms which use vibrations, laser light, and/or ultrasound.

The low pressure zone upstream from and adjacent to the low pressure device 14(2) triggers flashing to occur which leads to the presence of vapor phase, i.e. bubbles, in the flow F. This nucleation and flashing prevents any further superheating of the wall of the channel 12(4) and/or flow F. The flow F with the bubbles is able to effectively transfer heat to the flow F through the wall of the channel 12(4) resulting in improved heat transfer characteristics when compared with prior systems. The low pressure device 14(2) also increases the resistance to backflow in the channel 12(4) to provide further flow stability.

The operation of the system 10(5) for stabilizing flow F will be described with reference to FIG. 4A. The operation of the system 10(5) is the same as the system 10(2), except as described herein. As described in greater detail with reference to the nucleation cavities 20(1) in system 10(4), nucleation cavities 20(2) are formed in the wall of the channel 12(5) at a location where the superheat of the flow F is moderate to initiate nucleation over the nucleation cavities 20(2), but is not large enough to create modest or severe instability in the flow F due to late nucleation.

The flow F enters the inlet 24(5) to the channel 12(5) and flows from the high pressure region 28(5) to the low pressure region 30(5) through the passage 32(5). The low pressure zone upstream from and adjacent to the transition from the high pressure region 28(5) to the low pressure region 30(5) along with the nucleation at the nucleation cavities 20(2) triggers flashing to occur which leads to the presence of vapor phase, i.e. bubbles, in the flow F. This prevents any further superheating of the wall of the channel 12(5) and/or flow F. The flow F with the bubbles is able to effectively transfer heat to the flow F through the wall of the channel 12(5) resulting in improved heat transfer characteristics when compared with prior systems. This configuration of the channel 12(5) with the high pressure region 28(5) of the channel being narrower than the low pressure region 30(5) also increases the resistance to backflow in the channel 12(5) to provide further flow stability.

The operation of the system 10(6) for stabilizing flow F will be described with reference to FIG. 4B. The operation of the system 10(6) is the same as the system 10(3), except as described herein. As described in greater detail with reference to the nucleation cavities 20(1) in system 10(4), nucleation cavities 20(3) are formed in the wall of the channel 12(6) at a location where the superheat of the flow F is moderate to initiate nucleation over the nucleation cavities 20(3), but is not large enough to create modest or severe instability in the flow F due to late nucleation The flow F enters the inlet 24(6) to the channel 12(6) and flows from the high pressure region 28(6) to the low pressure region 30(6) through the passage 32(6). The low pressure zone upstream from and adjacent to the transition from the high pressure region 28(6) to the low pressure region 30(6) along with the nucleation at the nucleation cavities 20(3) triggers flashing to occur which leads to the presence of vapor phase, i.e. bubbles, in the flow F. This prevents any further superheating of the wall of the channel 12(6) and/or flow F. The flow F with the bubbles is able to effectively transfer heat to the flow F through the wall of the channel 12(6) resulting in improved heat transfer characteristics when compared with prior systems. This configuration of the channel 12(6) with the high pressure region 28(6) of the channel being narrower than the low pressure region 30(6) also increases the resistance to backflow in the channel 12(6) to provide further flow stability.

The operation of the system 10(7) for stabilizing flow F will be described with reference to FIG. 5. The operation of the system 10(7) is the same as the system 10(4), except as described herein. As described in greater detail with reference to the nucleation cavities 20(1) in system 10(4), nucleation cavities 20(4) are formed in a substantially uniform pattern along a section of the wall of the channel 12(7) where the superheat of the flow F is moderate to initiate nucleation over the nucleation cavities 20(4), but is not large enough to create modest or severe instability in the flow F due to late nucleation.

Once the system 10(7) is formed, the flow F enters the inlet 24(7) and flows through the channel 12(7). The nucleation cavities 20(4) initiate nucleation in the flow F. This nucleation prevents any further superheating of the wall of the channel 12(7) and/or flow F. The flow F with the bubbles is able to effectively transfer heat to the flow F through the wall of the channel 12(7) resulting in improved heat transfer characteristics when compared with prior systems.

The operation of the system 10(8) for stabilizing flow F will be described with reference to FIG. 6. The operation of the system 10(8) is the same as the system 10(7), except as described herein. As described in greater detail with reference to the nucleation cavities 20(1) in system 10(4), nucleation cavities 20(5) are formed in a random pattern along a section of the wall of the channel 12(8) where the superheat of the flow F is moderate to initiate nucleation over the nucleation cavities 20(5), but is not large enough to create modest or severe instability in the flow F due to late nucleation.

Once the system 10(8) is formed, the flow F enters the inlet 24(8) and flows through the channel 12(8). The nucleation cavities 20(5) initiate nucleation in the flow F. This nucleation prevents any further superheating of the wall of the channel 12(8) and/or flow F. The flow F with the bubbles is able to effectively transfer heat to the flow F through the wall of the channel 12(8) resulting in improved heat transfer characteristics when compared with prior systems.

The operation of the system 10(9) for stabilizing flow F will be described with reference to FIG. 7. The operation of the system 10(9) is the same as the system 10(1), except as described herein. The location where the wall and/or the flow F is expected to be slightly superheated (within a few degrees), such that flashing occurs, may be identified. The low pressure device 14(3) can be positioned in the channel 12(9) before that location and spaced in from the inlet 24(9) and outlet 26(9) to the channel 12(9).

As described in greater detail with reference to the nucleation cavities 20(1) in system 10(4), nucleation cavities 20(6) are formed in a substantially uniform pattern along a section of the wall of the channel 12(9) where the superheat of the flow F is moderate to initiate nucleation over the nucleation cavities 20(6), but is not large enough to create modest or severe instability in the flow F due to late nucleation.

Next, the flow F enters the inlet 24(9) to the channel 12(9) and flows from the high pressure region 28(7) to the low pressure region 30(7) through the passage 32(7) in the low pressure device 14(3). The low pressure zone upstream from and adjacent to the low pressure device 14(3) along with the nucleation at the nucleation cavities 20(6) triggers flashing to occur which leads to the presence of vapor phase, i.e. bubbles, in the flow F. This prevents any further superheating of the wall of the channel 12(9) and/or flow F. The flow F with the bubbles is able to effectively transfer heat to the flow F through the wall of the channel 12(9) resulting in improved heat transfer characteristics when compared with prior systems. The low pressure device 14(1) also increases the resistance to backflow in the channel 12(9) to provide further flow stability.

The operation of the system 10(10) for stabilizing flow F will be described with reference to FIG. 8. The operation of the system 10(10) is the same as the system 10(4), except as described herein. As described in greater detail with reference to the nucleation cavities 20(1) in system 10(4), nucleation cavities 20(7) are formed in a random pattern along a section of the wall of the channel 12(10) where the superheat of the flow F is moderate to initiate nucleation over the nucleation cavities 20(7), but is not large enough to create modest or severe instability in the flow F due to late nucleation. The heating device 18(2) is positioned around the channel 12(10) adjacent the location of the nucleation cavities 20(7).

Once the system 10(10) is formed, the flow F enters the inlet 24(10) and flows through the channel 12(10). The heating device 18(2) heats the wall of the channel adjacent the location of the nucleation cavities 20(7). Heating the nucleation cavities 20(7) helps to initiate nucleation in the flow F. This nucleation prevents any further superheating of the wall of the channel 12(10) and/or flow F. The flow F with the bubbles is able to effectively transfer heat to the flow F through the wall of the channel 12(10) resulting in improved heat transfer characteristics when compared with prior systems.

Another way for improving heat transfer performance and stability in systems, such as system 10(1)-10(10) involves the use of dissolved gases in the flow F. The dissolved gases helps in early nucleation and thereby limit the superheat of the flow F and bubble growth rate after bubble formation. The flow F containing dissolved gases can be used either alone with naturally occurring nucleation cavities or can be used in conjunction with other embodiments described herein. The dissolved gases form bubbles that attach on the wall of the channel and/or are in the flow F thus effectively creating interfaces between liquid and gas or gas vapor mixture where evaporation can occur at relatively low liquid and/or wall superheats.

Yet another way for improving heat transfer performance and stability involves the introduction of microbubbles in the flow F. The microbubbles may be made of gases that are not soluble, or have limited solubility in the liquid. Any technique for generation of microbubbles can be implemented. The presence of microbubbles limits the liquid superheat as the liquid evaporates at the bubble interface and limits this liquid superheat. The bubbles may attach on the wall and/or flow in the liquid thus effectively creating interfaces between liquid and gas or gas vapor mixture where evaporation can occur at relatively low liquid and/or wall superheats.

The present invention provides methods and systems to stabilize the flow during flow boiling in a channel or-channels. The systems 10(1)-10(10) described herein are merely exemplary and other combinations of the teachings in each can be used. The present invention utilizes pressure reduction and/or strategically placed nucleation cavities to achieve flow boiling under stable and workable operating conditions. The present invention can be used during flow boiling in any channel or channels to achieve stable flow and efficient heat removal. The various methods and systems for stabilizing flow, such as the methods and systems which use low pressure zone(s), use one or more nucleation cavities, heat portions or all of the channel(s), introduce non-soluble gases, microbubbles, or higher volatile liquid, can each be combined with one or more of the other embodiments to provide further flow stability.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A method for stabilizing flow during flow boiling, the method comprising:

introducing a flow into a channel with a minimum cross-sectional dimension of less than three millimeters;

insulating at least a portion of an inner surface of the channel in a high pressure zone; and triggering a release of one or more bubbles in the flow at one or more locations in the channel to stabilize the flow, wherein the one or more locations are spaced in from an inlet and an outlet to the channel, wherein the triggering a release further comprises passing the flow from the higher pressure zone through a low pressure zone in the channel.

2. The method as set forth in claim 1 wherein the triggering a release further comprises heating a portion of the channel which is located at at least one of upstream of the low pressure zone and substantially around the low pressure zone.

3. A method for making a system for stabilizing flow during flow boiling, the method comprising:

identifying one or more locations in a channel with a minimum cross-sectional dimension of less than three millimeters to trigger a release of one or more bubbles in the flow; and forming one or more triggering sites at the one or more identified locations in the channel, the one or more triggering sites trigger a release of one or more bubbles in flow in the channel to stabilize the flow, wherein the triggering sites comprise one or more nucleation cavities, a size and shape of the nucleation cavities is determined based on at least one of a geometry of the channel and a range of conditions for the flow;

wherein the triggering sites comprises a low pressure zone after a high pressure zone in the channel and farther comprising insulating at least a portion of an inner surface of the channel in the high pressure zone.

4. A method for stabilizing flow during flow boiling, the method comprising:

introducing a flow into a channel with a minimum cross-sectional dimension of less than three millimeters;

identifying one or more locations in the channel to trigger a release of one or more bubbles in the flow; and triggering the release of one or more bubbles in the flow at the one or more identified locations in the channel to stabilize the flow, wherein the one or more identified locations are spaced in from an inlet and an outlet to the channel;

wherein the triggering a release further comprises passing the flow by one or more nucleation cavities, each of the nucleation cavities having a radius within a range which satisfies criteria for nucleation, a size and shape of each of the nucleation cavities is determined based on at least one of a geometry of the channel and a range of conditions for the flow;

wherein the triggering a release further comprises passing the flow from a higher pressure zone through a low pressure zone in the channel, wherein at least a portion of an inner surface of the channel in the higher pressure zone is insulated.

5. A method for stabilizing flow during flow boiling, the method comprising:

introducing a flow into a channel with a minimum cross-sectional dimension of less than three millimeters; and triggering a release of one or more bubbles in the flow at one or more locations in the channel to stabilize the flow, wherein the triggering a release farther comprises passing the flow by one or more nucleation cavities, each of the nucleation cavities having a radius within a range which satisfies criteria for nucleation, a size and shape of each of the nucleation cavities is determined based on at least one of a geometry of the channel and a range of conditions for the flow;

wherein the triggering a release further comprises passing the flow from a higher pressure zone through a low pressure zone in the channel, wherein at least a portion of an inner surface of the channel in the higher pressure zone is insulated.

* * * * *